US011885324B2

(12) United States Patent
Roney, IV et al.

(10) Patent No.: US 11,885,324 B2
(45) Date of Patent: Jan. 30, 2024

(54) SYSTEMS AND METHODS OF CONTROLLING AN ELECTRIC MOTOR THAT OPERATES A PUMP JACK

(71) Applicant: POWER IT PERFECT, INC., Plano, TX (US)

(72) Inventors: Edward Milton Roney, IV, Clayton, NC (US); Corey Smith, Allen, TX (US); Drew Thacker, Colleyville, TX (US)

(73) Assignee: POWER IT PERFECT, INC., Plano, TX (US)

( * ) Notice: Subject to any disclaimer, the term of this patent is extended or adjusted under 35 U.S.C. 154(b) by 163 days.

(21) Appl. No.: 16/655,063

(22) Filed: Oct. 16, 2019

(65) Prior Publication Data

US 2020/0355064 A1 Nov. 12, 2020

Related U.S. Application Data

(60) Provisional application No. 62/844,230, filed on May 7, 2019.

(51) Int. Cl.
*F04B 47/02* (2006.01)
*E21B 43/12* (2006.01)
(Continued)

(52) U.S. Cl.
CPC ..... *F04B 47/022* (2013.01); *E21B 43/127* (2013.01); *E21B 47/009* (2020.05);
(Continued)

(58) Field of Classification Search
CPC .. E21B 43/022; E21B 43/127; E21B 2200/20; F04B 49/065; F04B 47/022; F04B 17/03
See application file for complete search history.

(56) References Cited

U.S. PATENT DOCUMENTS 4,145,161 A * 3/1979 Skinner ..... H02P 23/14 417/45
5,291,777 A * 3/1994 Chang ..... E21B 43/127 417/18

(Continued)

OTHER PUBLICATIONS

International Search Report and Written Opinion issued by ISA/US for related International Application No. PCT/US20/31762, dated Jul. 31, 2020; 20 pages.

(Continued)

*Primary Examiner* — Charles G Freay
(74) *Attorney, Agent, or Firm* — HAYNES AND BOONE, LLP

(57) ABSTRACT

Systems and methods of controlling the performance of client nodes served by an electric power utility are provided. In one exemplary embodiment, a method performed by a first network node that is operable to control via a client node an electric motor configured to operate a pump jack comprises sending, to the client node, an indication to change an amount of electric power consumed by the motor to operate the pump jack based on at least one of a value of a first parameter associated with operation of the motor and a value of a second parameter associated with operation of the pump jack so as to reduce an average amount of electric power consumed during a certain time period by the motor in operating the pump jack.

6 Claims, 17 Drawing Sheets

(51) Int. Cl.

| | |
|---|---|
| ***E21B 47/009*** | (2012.01) |
| ***F04B 49/06*** | (2006.01) |
| ***F04B 17/03*** | (2006.01) |
| ***F04B 15/02*** | (2006.01) |

(52) U.S. Cl.
CPC ..... *F04B 15/02* (2013.01); *F04B 17/03* (2013.01); *F04B 49/065* (2013.01); *E21B 2200/20* (2020.05); *F04B 2205/14* (2013.01)

(56) References Cited

U.S. PATENT DOCUMENTS

| | | | | |
|---|---|---|---|---|
| 9,033,676 | B2 * | 5/2015 | Palka | F04B 49/065 417/44.1 |
| 10,612,538 | B2 * | 4/2020 | Baker | F04B 47/022 |
| 2004/0062657 | A1 | 4/2004 | Beck et al. | |
| 2011/0097214 | A1 | 4/2011 | Wentworth et al. | |
| 2013/0127390 | A1 | 5/2013 | DaCunha et al. | |
| 2014/0343743 | A1 * | 11/2014 | DaCunha | G06Q 50/06 713/340 |
| 2016/0032703 | A1 | 2/2016 | Broussard et al. | |
| 2016/0194942 | A1 | 7/2016 | Wiegman et al. | |
| 2017/0363079 | A1 | 12/2017 | Baker | |
| 2020/0182028 | A1 * | 6/2020 | Ewing | E21B 43/127 |
| 2020/0263531 | A1 * | 8/2020 | Fyfe | F04B 51/00 |

OTHER PUBLICATIONS

Wang et al., SPE-191803-MS: A New Model to Evaluate Polished Rod Load of Sucker Rod Pumping, Abstract, Society of Petroleum Engineers, Sep. 5, 2018, Society of Petroleum Engineers Liquids-Rich Basins Conference—North America, Midland, Texas; 21 pages.

Sucker-rod lift: Understanding the Reservoir, Petrowiki, Jan. 19, 2016, Copyright 2012-2022, Society of Petroleum Engineers; 18 pages.

Peh: Sucker-Rod Lift, Prime Movers, Power Factors, Petrowiki, Jan. 19, 2016, Copyright 2012-2022, Society of Petroleum Engineers; 37 pages.

Hopkins et al., SPE 121345: Operational Energy Savings Through the Use of Continuous Sucker Rods with Progressing-Cavity Pumps, Society of Petroleum Engineers, Mar. 24-26, 2009, Society of Petroleum Engineers Western Regional Meeting, San Jose, California; 7 pages.

Demin et al., SPE Production & Facilities: Viscous-Elastic Polymer Fluids Rheology and Its Effect Upon Production Equipment, Copyright Nov. 2004, Society of Petroleum Engineers; 8 pages.

Reducing Power Factor Cost Fact Sheet, U.S. Department of Energy, Office of Energy Efficiency and Renewable Energy, Dec. 1, 2013; 5 pages.

* cited by examiner

SYSTEMS AND METHODS OF CONTROLLING AN ELECTRIC MOTOR THAT OPERATES A PUMP JACK

CROSS REFERENCE TO RELATED APPLICATIONS

This application claims the benefit of U.S. Provisional Application No. 62/844,230, filed May 7, 2019, the contents of which are incorporated herein by reference in its entirety.

FIELD OF DISCLOSURE

The present disclosure relates generally to the field of oil field management, and in particular to systems and methods of controlling an electric motor that operates a pump jack.

BACKGROUND

During the production of fluids such as hydrocarbons from a well that drains an underground reservoir, it is important to understand the behavior and impact of that reservoir so as to allow for optimized production of fluid as that reservoir changes. The current techniques for monitoring reservoirs typically require human analysis of sensor data prior to making any modifications to well site operations to optimize production. Further, such human analysis may not provide any new information associated with the reservoir as substantial effort may be required to identify new information and even if new information is found, any resulting modifications to well site operations may not be implemented in real-time and instead, may be implemented over an extended period of time. In addition, human analysis of well site data typically does not lend itself to rapid or real-time responses to changes in the reservoir or the well site operations such as changes to flow rate, pressure and fluid chemistry.

For fluid production, a pump jack is typically used to mechanically pump fluid from a reservoir when well pressure is insufficient to force the fluid to the surface. These devices operate using a weight/counterweight system with a metal sucker rod extended into the earth on one side of a fulcrum and a counterweight on the other side to offset the weight of the rod and fluid. At the end of the rod is a one-way valve that traps the fluid and forces it to rise through pipes as the counterweight descends and the rod rises. To actuate the weight/counterweight system, an electric motor (e.g., AC induction motor) is used.

Electric motors are typically designed to operate at high efficiency when operating, for instance, at greater than 75% load. However, as the load on a motor is reduced, the overall efficiency of the motor declines and the resulting losses impact the overall efficiency of the well site operation. As such, decrease in the efficiency of a motor results in an increased amount of electric power consumed by that motor. For well site operations, the motor driving the pump jack experiences different loads throughout the cycle of the weigh/counterweight system. During the portion of the cycle when the counterweight is being lifted, the motor operates at a higher load, resulting in the motor operating at a higher efficiency. As the counterweight falls, the motor operates at a lower load, resulting in the motor operating at a lower efficiency. In addition, the load of the motor is impacted by the fluid reservoir as well as changes to that reservoir that may result in the motor operating at a lower efficiency. Accordingly, there is a need for improved techniques for controlling an electric motor that operates a pump jack so as to reduce an average amount of electric power consumed during a certain time period by the motor in operating the pump jack. In addition, other desirable features and characteristics of the present disclosure will become apparent from the subsequent detailed description and embodiments, taken in conjunction with the accompanying figures and the foregoing technical field and background.

The Background section of this document is provided to place embodiments of the present disclosure in technological and operational context, to assist those of skill in the art in understanding their scope and utility. Unless explicitly identified as such, no statement herein is admitted to be prior art merely by its inclusion in the Background section.

SUMMARY

The following presents a simplified summary of the disclosure in order to provide a basic understanding to those of skill in the art. This summary is not an extensive overview of the disclosure and is not intended to identify key/critical elements of embodiments of the disclosure or to delineate the scope of the disclosure. The sole purpose of this summary is to present some concepts disclosed herein in a simplified form as a prelude to the more detailed description that is presented later.

Briefly described, embodiment of the present disclosure relate to systems and methods of controlling an electric motor that operates a pump jack. According to one aspect, a method performed by a first network node that is operable to control via a client node an electric motor configured to operate a pump jack comprises sending, by the first network node, to the client node, an indication to change an amount of electric power consumed by the motor to operate the pump jack based on at least one of a value of a first parameter associated with operation of the motor and a value of a second parameter associated with operation of the pump jack so as to reduce an average amount of electric power consumed during a certain time period by the motor in operating the pump jack. Further, at least one of the values of the first and second parameters are reported to the first network node by the client node.

According to another aspect, the step of sending the indication to change the amount of electric power consumed by the motor is responsive to obtaining the indication to change an amount of electric power consumed by the motor.

According to another aspect, the step of obtaining the indication to change the amount of electric power consumed by the motor includes receiving, from a second network node that is associated with an electric power utility that provides electric power to the motor, an indication to change the amount of power consumed by the motor.

According to another aspect, the step of obtaining the indication to change the amount of electric power consumed by the motor is responsive to determining that a timer associated with enabling or disabling the motor has expired.

According to another aspect, the timer is associated with a duration of time that the motor will operate.

According to another aspect, the method includes receiving, by the first network node, from the client node, at least one of the values of the first and second parameters. Further, the method includes determining at least one the values of the first and second parameters.

According to another aspect, the second parameter corresponds to a composition of fluid produced by the pump jack.

According to another aspect, the second parameter corresponds to a pressure of fluid produced by the pump jack.

According to another aspect, the second parameter corresponds to a viscosity of fluid produced by the pump jack.

According to another aspect, the second parameter corresponds to a level of fluid produced by the pump jack that is stored in a battery.

According to another aspect, the first parameter is associated with an amount of electric power consumed by the motor.

According to another aspect, the first parameter is associated with a revolutions per second (RPM) of the motor.

According to another aspect, the first parameter is associated with a power factor (PF) of the motor.

According to another aspect, the indication to change an amount of electric power consumed by the motor includes an indication to enable or disable electric power to the motor.

According to another aspect, the indication to change an amount of electric power consumed by the motor includes an indication to increase or decrease an amount of electric power to the motor.

According to one aspect, a first network node operable to control via a client node an electric motor configured to operate a pump jack comprises processing circuitry and memory, the memory containing instructions executable by the processing circuitry whereby the first network node is configured to send, to the client node, an indication to change an amount of electric power consumed by the motor to operate the pump jack based on at least one of a value of a first parameter associated with operation of the motor and a value of a second parameter associated with operation of the pump jack so as to reduce an average amount of electric power consumed during a certain time period by the motor in operating the pump jack. Further, at least one of the values of the first and second parameters are reported to the first network node by the client node.

According to one aspect, a method is performed by a first network node that is operable to control performance of client nodes served by an electric power utility. The method includes obtaining an indication to change electric power consumed or delivered by a plurality of client nodes that are directly or indirectly controlled by the first network node. Further, each client node is operable to consume or deliver electric power from or to the utility. The method also includes determining a next amount of electric power to be consumed or delivered by each client node. Further, the method includes estimating a current amount of electric power consumed or delivered by each client node. In addition, the method includes determining a value of one or more performance parameters for each client node based on the next and current amounts of electric power for that client node. One or more values of each parameter is associated with different amounts of electric power consumed or delivered by each client node. Finally, the method includes sending, to each client node, an indication of the value of the one or more parameters so that the amount of electric power consumed or delivered by that client node changes from the current amount to the next amount of electric power for that client node.

According to another aspect, the step of obtaining includes receiving, from a second network node that is associated with the utility, an indication to change the amount of power consumed or delivered by the client nodes.

According to another aspect, the indication to change the amount of power consumed or delivered by the client nodes indicates to increase or decrease the amount of electric power consumed or delivered by the client nodes.

According to another aspect, the step of determining the next amount of electric power to be consumed or delivered by each client node includes increasing or decreasing the current amount for each client node by a predetermined amount to obtain the next amount for that client node.

According to another aspect, the step of determining the estimated amount of electric power consumed or delivered by each client node includes obtaining an indication of the estimated amount of electric power consumed or delivered by each client node.

According to another aspect, the step of obtaining the indication of the estimated amount includes receiving, from each client node, an indication of the estimated amount of electric power consumed or delivered by that client node.

According to another aspect, the one or more values of each parameter corresponds to a range of electric power consumed or delivered by each client node.

According to another aspect, the at least one parameter includes a parameter associated with an electric motor or generator.

According to another aspect, a first portion of the client nodes are electric motors and a second portion of the client nodes are electric generators.

According to another aspect, the one or more parameters includes a parameter associated with a speed (e.g., revolutions per second) of an electric motor or generator.

According to another aspect, the one or more parameters includes a parameter associated with a torque of an electric motor or generator.

According to another aspect, the one or more parameters includes a parameter associated with whether an electric motor or generator is powered on or off.

According to another aspect, the one or more parameters includes a parameter associated with a duty cycle of a pump jack.

According to another aspect, the one or more parameters includes a parameter associated with a flow of a fluid associated with a pump jack.

According to another aspect, the fluid includes natural gas.

According to another aspect, the fluid includes oil.

According to one aspect, a first network node is operable to control performance of client nodes served by an electric power utility and configured to perform any of the steps described herein.

According to one aspect, a first network node operable to control performance of client nodes served by an electric power utility comprises processing circuitry configured to perform any of the steps described herein.

According to one aspect, a first network node operable to control performance of client nodes served by an electric power utility comprises processing circuitry and memory, with the memory containing instructions executable by the processing circuitry whereby the network node is configured to perform any of the steps described herein.

According to one aspect, a first network node operable to control performance of client nodes served by an electric power utility comprises an obtaining circuit configured to obtain an indication to change electric power consumed or delivered by a plurality of client nodes that are directly or indirectly controlled by the first network node and that provide or deliver electric power to the same electric power utility. Further, the first network node includes a next power determination circuit configured to determine a next amount of electric power to be consumed or delivered by each client node. The first network node also includes a current power estimation circuit configured to estimate a current amount of electric power consumed or delivered by each client node. In addition, the first network node includes a parameter determination circuit configured to determine a value of one or more performance parameters for each client node based on the next and current amounts of electric power for that client node. One or more values of each parameter is associated with different amounts of electric power consumed or delivered by each client node. The first network node includes a sending circuit configured to send, to each client node, an indication of the value of the one or more parameters so that the amount of electric power consumed or delivered by that client node changes from the current amount to the next amount for that client node.

According to one aspect, a computer program comprising instructions which, when executed by one or more processors of a first network node that is operable to control performance of client nodes served by an electric power utility, causes the first network node to carry out any of the steps described herein. In addition, a carrier may contain the computer program, with the carrier being one of an electronic signal, optical signal, radio signal, or computer readable storage medium.

According to one aspect, a method performed by a second network node that is associated with an electric power utility for controlling performance of client nodes served by that utility comprises determining to change an amount of electric power consumed or delivered by a plurality of client nodes that are directly or indirectly controlled by a first network node that is operable to control performance of the client nodes served by that utility, with each client node being operable to consume or deliver electric power from or to the utility. Further, the method includes sending, to the first network node, an indication to change the amount of power consumed or delivered by the client nodes.

According to another aspect, the method includes obtaining an amount of electric power to be consumed or delivered by the client nodes. Further, the indication to change the amount of power consumed or delivered by the client nodes includes the amount of power to change.

According to another aspect, the step of obtaining an amount of electric power to be consumed or delivered by the client nodes is responsive to receiving, from the first network node, a request to change the amount of electric power consumed or delivered by that client node.

According to another aspect, the method includes determining the amount of electric power to be consumed or delivered by the client nodes.

According to another aspect, the indication to change the amount of power consumed or delivered by the client nodes includes an indication to increase or decrease the amount of power consumed or delivered by each client node.

According to another aspect, a first portion of the client nodes is electric motors and a second portion of the client nodes is electric generators.

According to another aspect, the first network node is further operable to control performance of the client nodes served by the utility via one or more performance parameters of each client node.

According to another aspect, the one or more parameters includes a parameter associated with a speed (e.g., revolutions per second) of an electric motor or generator.

According to another aspect, the one or more parameters includes a parameter associated with a torque of an electric motor or generator.

According to another aspect, the one or more parameters includes a parameter associated with whether an electric motor or generator is powered on or off.

According to another aspect, the one or more parameters includes a parameter associated with a duty cycle of a pump jack.

According to another aspect, the one or more parameters includes a parameter associated with a flow of a fluid associated with an electric motor or generator.

According to one aspect, a second network node is configured to perform any of the steps described herein.

According to one aspect, a second network node comprises processing circuitry configured to perform any of the steps described herein.

According to one aspect, a second network node comprises processing circuitry and memory, with the memory containing instructions executable by the processing circuitry whereby the second network node is configured to perform any of the steps described herein.

According to one aspect, a second network node comprises a power change determination circuit configured to determine to change an amount of electric power consumed or delivered by a plurality of client nodes that are directly or indirectly controlled by a first network node that is operable to control performance of the client nodes served by the utility, with each client node being operable to consume or deliver electric power from or to the utility. Further, the second network node includes a send circuit configured to send, to the first network node, an indication to change the amount of power consumed or delivered by the client nodes.

According to one aspect, a computer program comprising instructions which, when executed by one or more processors of a second network node, causes the second network node to carry out any of the steps described herein. Further, a carrier containing the computer program is one of an electronic signal, optical signal, radio signal, or computer readable storage medium.

According to one aspect, a method performed by a client node that is operable to consume or generate electric power from or to an electric power utility comprises receiving, from a first network node that is operable to control performance of the client node via one or more performance parameters, an indication of a value of the one or more parameters. Further, the method includes updating the one or more parameters with the value so that the amount of electric power consumed by or delivered to that client node changes from a current amount to a next amount of electric power.

According to one embodiment, a client node is configured to perform any of the steps described herein.

According to one embodiment, a client node comprises processing circuitry configured to perform any of the steps described herein.

According to one embodiment, a client node comprises processing circuitry and memory, the memory containing instructions executable by the processing circuitry whereby the client node is configured to perform any of the steps described herein.

According to one embodiment, a client node comprises a receiver circuit configured to receive, from a first network node that is operable to control performance of the client node via one or more performance parameters, an indication of a value of the one or more parameters so that the amount of electric power consumed by or delivered to that client node changes from a current amount to a next amount of electric power.

According to one embodiment, a computer program comprising instructions which, when executed by one or more processors of a client node, causes the client node to carry out any of the steps described herein. Further, a carrier contains the computer program with the carrier being one of an electronic signal, optical signal, radio signal, or computer readable storage medium.

BRIEF DESCRIPTION OF THE DRAWINGS

The present disclosure will now be described more fully hereinafter with reference to the accompanying drawings, in which embodiments of the disclosure are shown. However, this disclosure should not be construed as limited to the embodiments set forth herein. Rather, these embodiments are provided so that this disclosure will be thorough and complete, and will fully convey the scope of the disclosure to those skilled in the art. Like numbers refer to like elements throughout.

DETAILED DESCRIPTION

For simplicity and illustrative purposes, the present disclosure is described by referring mainly to an exemplary embodiment thereof. In the following description, numerous specific details are set forth in order to provide a thorough understanding of the present disclosure. However, it will be readily apparent to one of ordinary skill in the art that the present disclosure may be practiced without limitation to these specific details.

Figure 1:
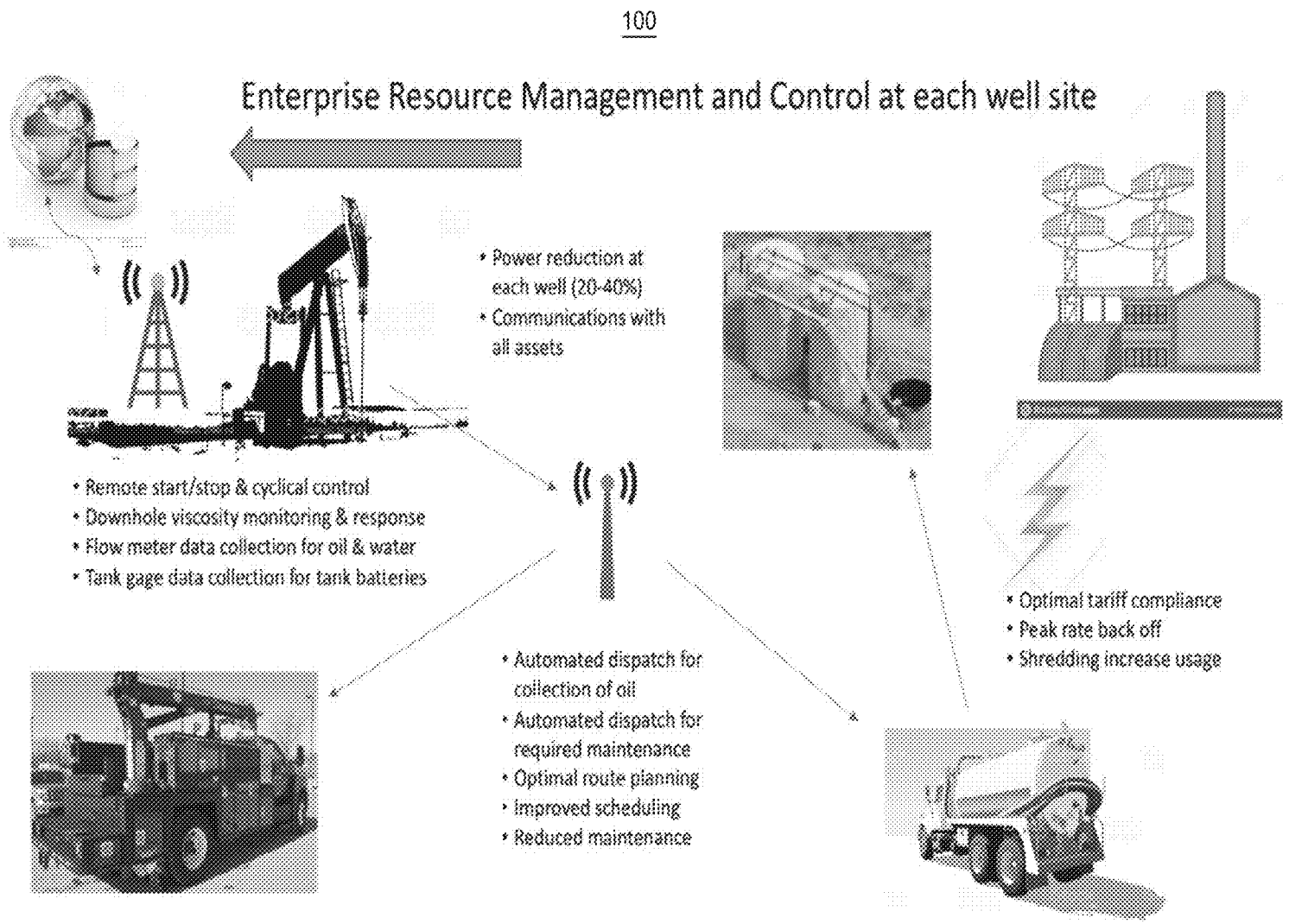
FIG. 1 illustrates one embodiment of a system of enterprise planning and control of well sites in accordance with various aspects as described herein.

In this disclosure, systems and methods of controlling an electric motor that operates a pump jack are provided. For example, FIG. 1 illustrates one embodiment of a system 100 of enterprise planning and control of well sites in accordance with various aspects as described herein. Power usage fluctuates as utility customers demand power for well-site operations (e.g., pump jack operations, flare gas operations). The electric power utility must consistently provide the electric power the pump jack operations needs every second of every day. This is known as demand and is recorded in kilowatts (kW). Demand is the primary determinant of electric rate structures. As the services demand increases, the rate structure for the well-site operations changes at specific set points. The system 100 is configured to reduce this overall electric power demand by reduced consumption of electric power by the well-site operations as directed by a network control center. The network control center monitors aspects of the well-site operations and provides data to a network node that is configured to reduce demand several ways: configuration and control of one or more components (e.g., motors, generators, pumps, or the like) co-located at the well site; detection of one or more characteristics (e.g., viscosity) of fluid (e.g., oil, gas, or the like) extracted at the well site; reduction of running hours of one or more components co-located at the well site to improve production of fluid extracted from the well site; time-of-day scheduling of well site operations to avoid peak rate billing by the electric power utility; monitoring of production of fluid extracted from the well site; detection of tank battery capacity; automated dispatch of fluid collection systems for the stored fluid; route scheduling and optimization of fluid collection service providers; automated dispatch of well field service for installations, repairs and maintenance; route scheduling and optimization for well field service providers; and contemporaneously controlling an unlimited number of well sites.

Figure 2:
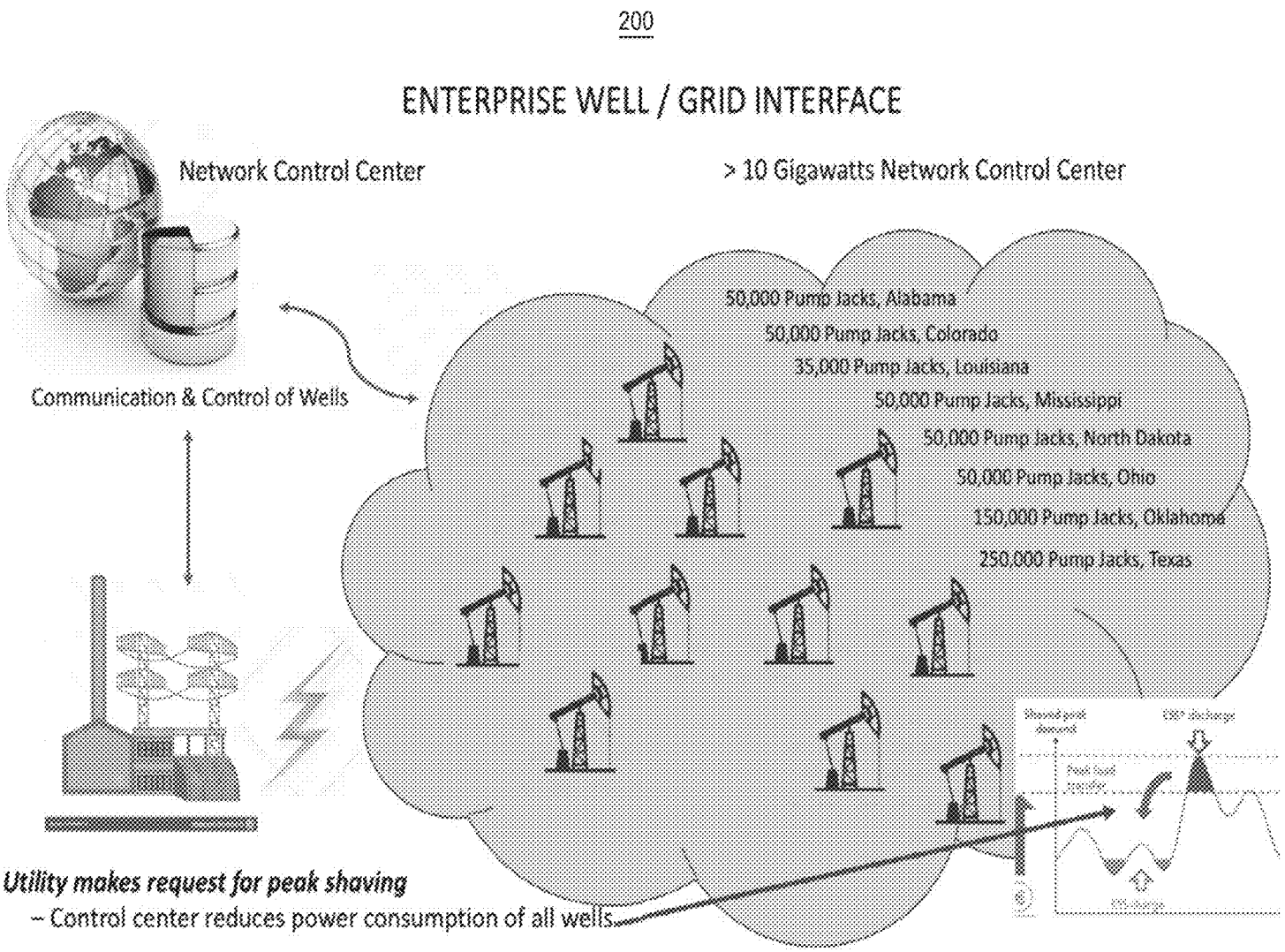
FIG. 2 illustrates another embodiment of a system of enterprise planning and control of well sites in accordance with various aspects as described herein.

FIG. 2 illustrates another embodiment of a system 200 of enterprise planning and control of well sites in accordance with various aspects as described herein. Hundreds of thousands of pump jacks will be controlled to enable electric power load distribution across an electrical grid. Control of mass amounts of electric power-hungry devices provides the ability to shave peak electric power demands. Along with control, this system 200 allows for in depth data acquisition down to every oil well. Various components at each well site are outfitted with an array of sensors to allow for data acquisition, monitoring, predictive maintenance, and scheduled dispatch for oil collection. This acquired data such as downhole viscosity, volume, power consumption, and speed will be collected and analyzed to provide insights and understanding of oil wells, oil collection, and the oil industry. Exploratory data analysis provides insight to oil patches at a macro level, which allows for improving costs associated with the extraction of oil.

Figure 3:
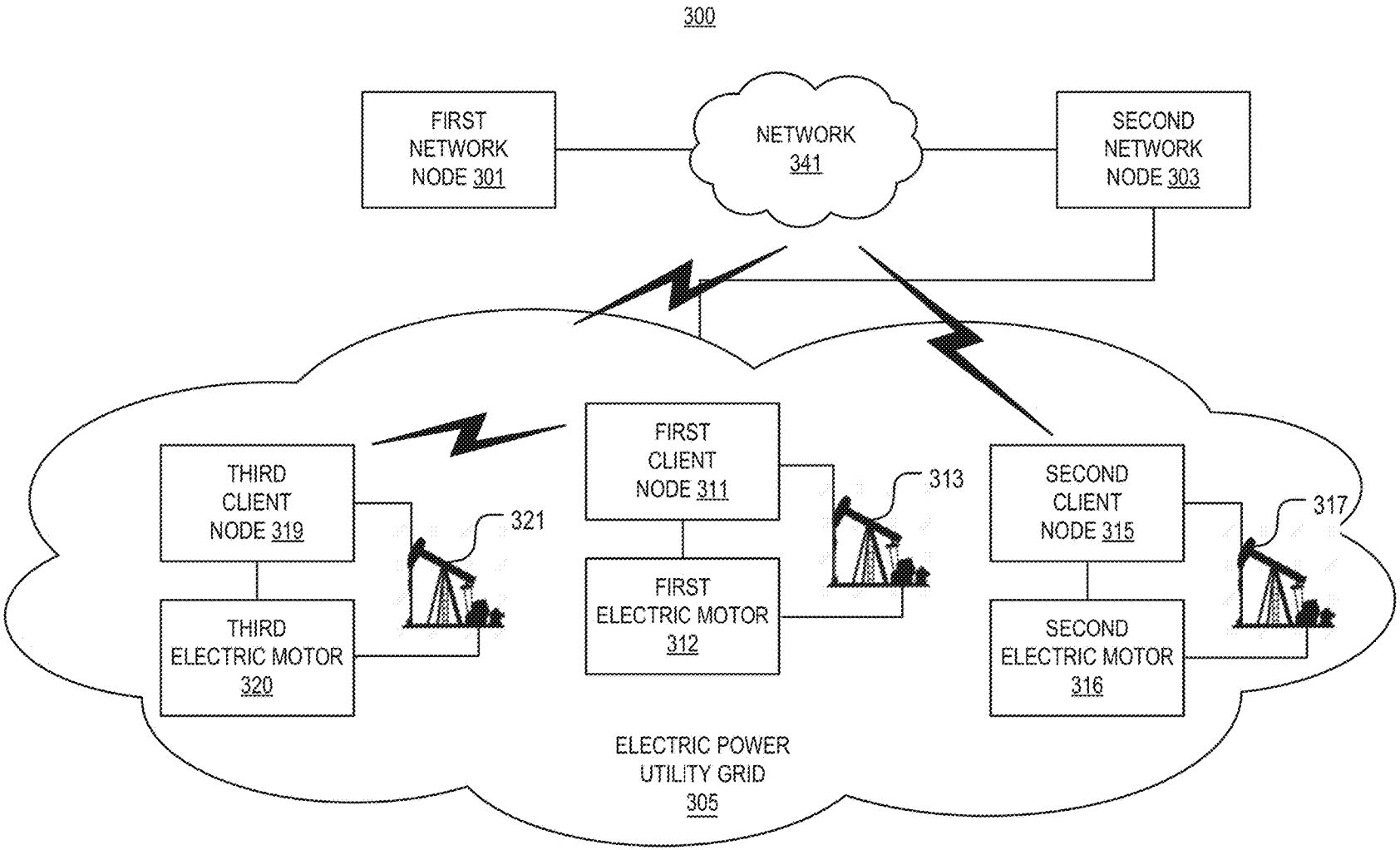
FIG. 3 illustrates one embodiment of a system of controlling performance of nodes served by an electric power utility in accordance with various aspects as described herein.

FIG. 3 illustrates one embodiment of a system 300 of controlling an electric motor that operates a pump jack in accordance with various aspects as described herein. In FIG. 3, the system 300 includes first network node 301, a second network node 303 associated with an electric power utility that provides electric power to electric power utility grid 305, and first, second and third client nodes 311, 315, 319.

Each of the client nodes 311, 315, 319 are operationally coupled to corresponding electric motors 312, 316, 320 that operate pump jacks 313, 317, 321. In operation, the second network node 303 sends, to the first network node 301, an indication to change the amount of power consumed by the motors 312, 316, 320. In response to receiving the indication to change the amount of power consumed by the motors 312, 316, 320, the first network node 301 sends, to each client node 311, 315, 319, an indication to change an amount of electric power consumed by the corresponding motor 312, 316, 320 to operate its pump jack 313, 317, 321 based on a value of a first parameter associated with operation of that motor 312, 316, 320 and a value of a second parameter associated with operation of that pump jack 313, 317, 321 so as to reduce an amount of electric power consumed by that motor 312, 316, 320 in operating its pump jack 313, 317, 321. Further, each client node 311, 315, 319 sends, to the first network node 301, values of the first and second parameters.

Figure 4:
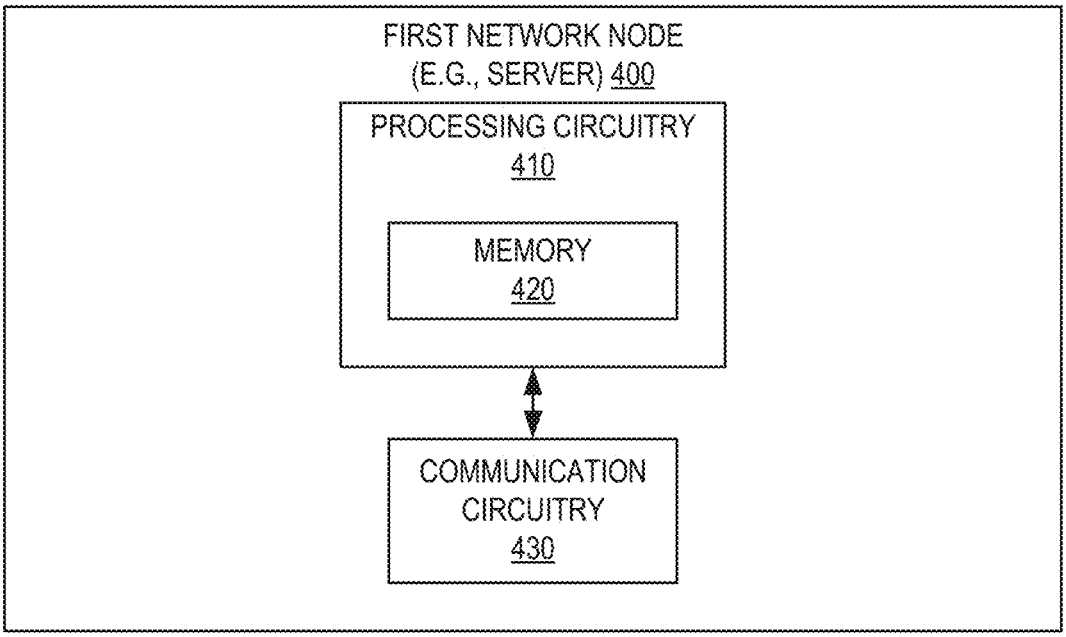
FIG. 4 illustrates one embodiment of a first network node in accordance with various aspects as described herein.

FIG. 4 illustrates one embodiment of a first network node 400 in accordance with various aspects as described herein. As shown, the first network node 400 includes processing circuitry 410 and communication circuitry 430. The communication circuitry 430 is configured to transmit and/or receive information to and/or from one or more other nodes (e.g., via any communication technology). The processing circuitry 410 is configured to perform processing described above, such as by executing instructions stored in memory 420. The processing circuitry 410 in this regard may implement certain functional means, units, or modules.

Figure 5:
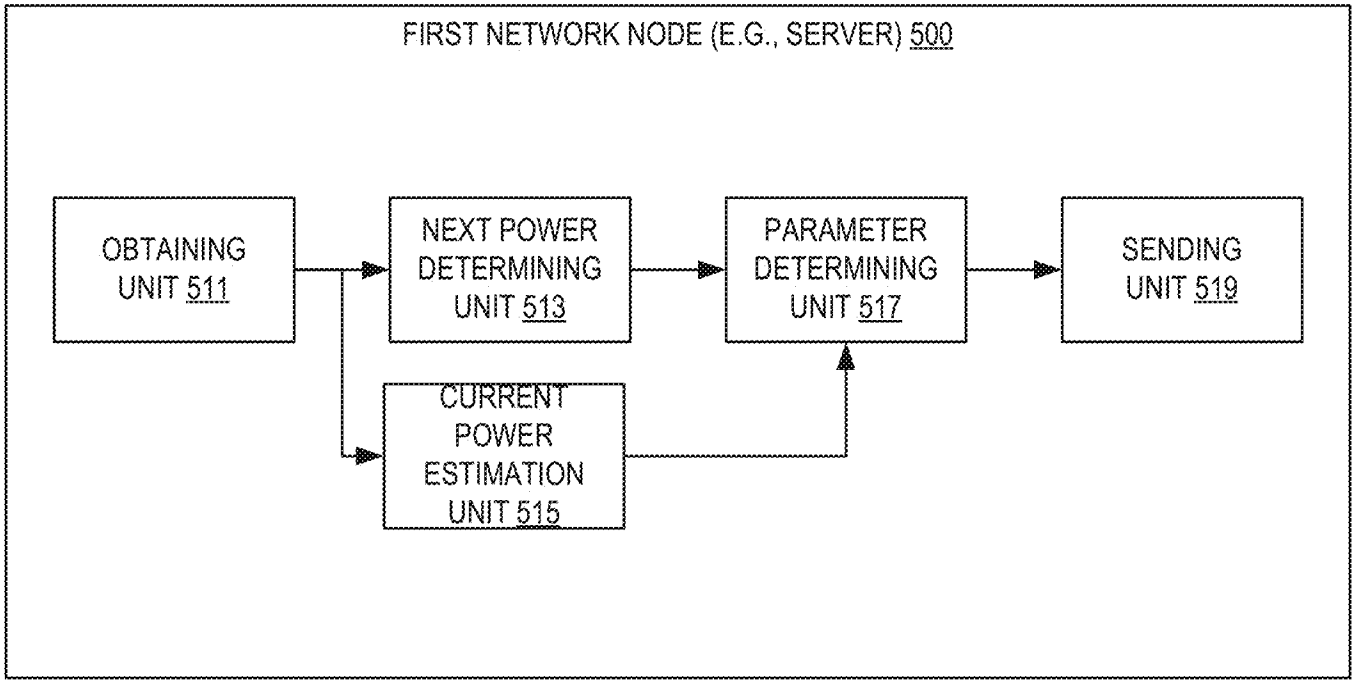
FIG. 5 illustrates another embodiment of a first network node in accordance with various aspects as described herein.

FIG. 5 illustrates another embodiment of a first network node 500 in accordance with various aspects as described herein. As shown, the first network node 500 implements various functional means, units, or modules (e.g., via the processing circuitry 410 in FIG. 4, via software code), or circuits. In one embodiment, these functional means, units, modules, or circuits (e.g., for implementing the method(s) herein) may include for instance: an obtaining unit 511 for obtaining an indication to change electric power consumed or delivered by a plurality of client nodes that are directly or indirectly controlled by the first network node 500; a next power determining unit 513 for determining a next amount of electric power to be consumed or delivered by each client node; a current power estimating unit 515 for estimating a current amount of electric power consumed or delivered by each client node; a parameter determining unit 517 for determining a value of one or more performance parameters for each client node based on the next and current amounts of electric power for that client node; and a sending unit 519 for sending, to each client node, an indication of the value of the one or more parameters.

Figure 6:
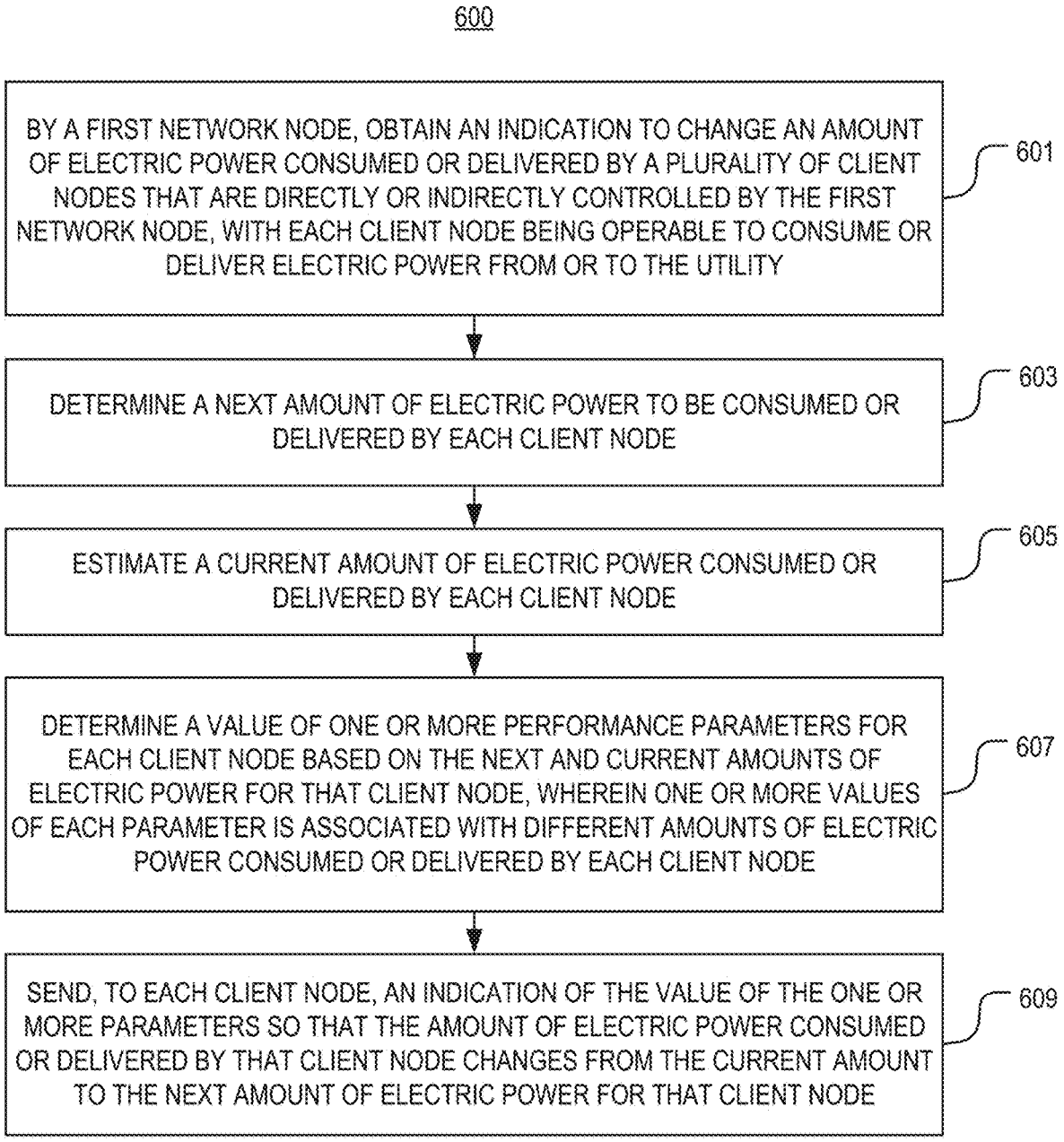
FIG. 6 illustrates one embodiment of a method performed by a first network node of controlling performance of client nodes served by an electric power utility in accordance with various aspects as described herein.

FIG. 6 illustrates one embodiment of a method 600 performed by a first network node of controlling performance of client nodes served by an electric power utility in accordance with various aspects as described herein. In FIG. 6, the method 600 may start, for instance, at block 601 where it includes obtaining an indication to change electric power consumed or delivered by a plurality of client nodes that are directly or indirectly controlled by the first network node. Further, each client node is operable to consume or deliver electric power from or to the utility. At block 603, the method 600 includes determining a next amount of electric power to be consumed or delivered by each client node. At block 605, the method 600 includes estimating a current amount of electric power consumed or delivered by each client node. Further, the method 600 includes determining a value of one or more performance parameters for each client node based on the next and current amounts of electric power for that client node, as referenced at block 607. Also, one or more values of each parameter is associated with different amounts of electric power consumed or delivered by each client node. In addition, the method 600 includes sending, to each client node, an indication of the value of the one or more parameters so that the amount of electric power consumed or delivered by that client node changes from the current amount to the next amount of electric power for that client node, as referenced at block 609.

Figure 7:
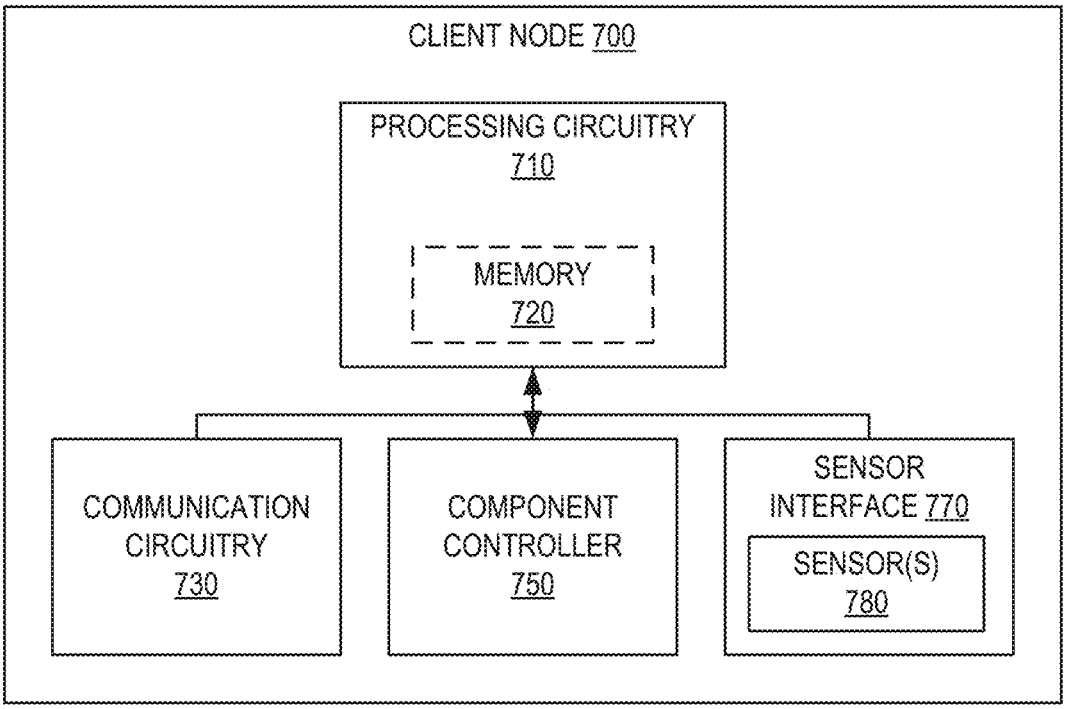
FIG. 7 illustrates one embodiment of a client node in accordance with various aspects as described herein.

FIG. 7 illustrates one embodiment of a client node 700 in accordance with various aspects as described herein. As shown, the client node 700 includes processing circuitry 710, communication circuitry 730, one or more sensors 780 (e.g., accelerometer, gyroscope, magnetometer, flow meter, flux meter, or the like), a component controller 750 (e.g., motor controller), or any combination thereof. The communication circuitry 730 is configured to transmit and/or receive information to and/or from one or more other nodes (e.g., via any communication technology). The processing circuitry 710 is configured to perform processing described above, such as by executing instructions stored in memory 720. The processing circuitry 710 in this regard may implement certain functional means, units, or modules.

Figure 8:
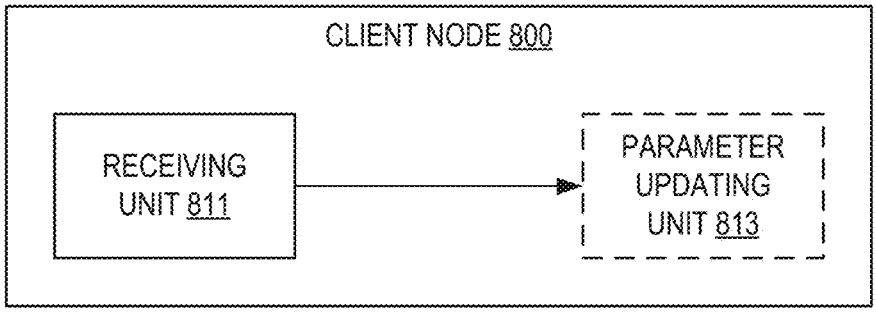
FIG. 8 illustrates another embodiment of a client node in accordance with various aspects as described herein.

FIG. 8 illustrates another embodiment of a client node 800 in accordance with various aspects as described herein. As shown, the client node 800 implements various functional means, units, or modules (e.g., via the processing circuitry 710 in FIG. 7, via software code), or circuits. In one embodiment, these functional means, units, modules, or circuits (e.g., for implementing the method(s) herein) may include for instance: a receiving unit 811 for receiving, from a first network node that is operable to control performance of the client node via one or more performance parameters, an indication of a value of the one or more parameters so that the amount of electric power consumed by or delivered to that client node changes from a current amount to a next amount of electric power; and a parameter updating unit 813 for updating the one or more parameters with the value so that the amount of electric power consumed by or delivered to that client node changes from a current amount to a next amount of electric power.

Figure 9:
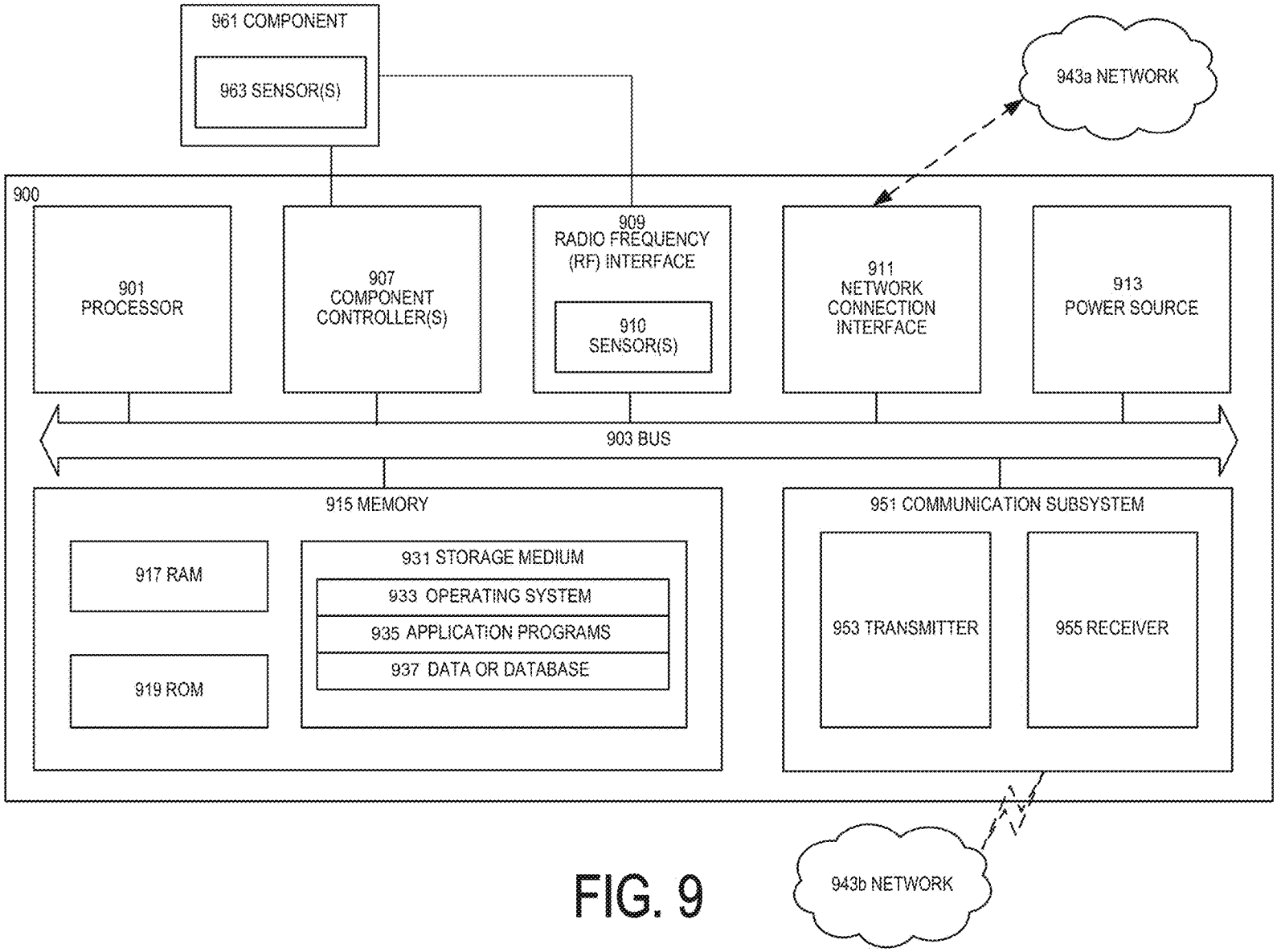
FIG. 9 illustrates another embodiment of a client node in accordance with various aspects as described herein.

FIG. 9 illustrates another embodiment of a client node 900 in accordance with various aspects as described herein. In FIG. 9, the client node 900 may be configured to include a processor 901 that is operatively coupled to a radio frequency (RF) interface 909, a network connection interface 911, a memory 915 including a random access memory (RAM) 917, a read only memory (ROM) 919, a storage medium 931 or the like, a communication subsystem 951, a power source 913, another component, or any combination thereof. The memory 915 may be used to store one or more databases. The storage medium 931 may include an operating system 933, an application program 935, data or database 937, or the like. Specific devices may utilize all of the components shown in FIG. 9, or only a subset of the components, and levels of integration may vary from device to device. Further, specific devices may contain multiple instances of a component, such as multiple processors, memories, transceivers, transmitters, receivers, etc. For instance, a computing device may be configured to include a processor and a memory.

In FIG. 9, the processor 901 may be configured to process computer instructions and data. The processor 901 may be configured as any sequential state machine operative to execute machine instructions stored as machine-readable computer programs in the memory, such as one or more hardware-implemented state machines (e.g., in discrete logic, FPGA, ASIC, etc.); programmable logic together with appropriate firmware; one or more stored-program, general-purpose processors, such as a microprocessor or Digital Signal Processor (DSP), together with appropriate software; or any combination of the above. For example, the processor 901 may include two computer processors. In one definition, data is information in a form suitable for use by a computer. It is important to note that a person having ordinary skill in the art will recognize that the subject matter of this disclosure may be implemented using various operating systems or combinations of operating systems.

In FIG. 9, the RF interface 909 may be configured to provide a communication interface to RF components such as a transmitter, a receiver, and an antenna. The network connection interface 911 may be configured to provide a communication interface to a network 943*a*. The network 943*a* may encompass wired and wireless communication networks such as a local-area network (LAN), a wide-area network (WAN), a computer network, a wireless network, a telecommunications network, another like network or any combination thereof. For example, the network 943*a* may be a Wi-Fi network. The network connection interface 911 may be configured to include a receiver and a transmitter interface used to communicate with one or more other nodes over a communication network according to one or more communication protocols known in the art or that may be developed, such as Ethernet, TCP/IP, SONET, ATM, or the like. The network connection interface 911 may implement receiver and transmitter functionality appropriate to the communication network links (e.g., optical, electrical, and the like). The transmitter and receiver functions may share circuit components, software or firmware, or alternatively may be implemented separately.

In this embodiment, the RAM 917 may be configured to interface via the bus 903 to the processor 901 to provide storage or caching of data or computer instructions during the execution of software programs such as the operating system, application programs, and device drivers. The ROM 919 may be configured to provide computer instructions or data to the processor 901. For example, the ROM 919 may be configured to be invariant low-level system code or data for basic system functions such as basic input and output (I/O), startup, or reception of keystrokes from a keyboard that are stored in a non-volatile memory. The storage medium 931 may be configured to include memory such as RAM, ROM, programmable read-only memory (PROM), erasable programmable read-only memory (EPROM), electrically erasable programmable read-only memory (EEPROM), magnetic disks, optical disks, floppy disks, hard disks, removable cartridges, flash drives. In one example, the storage medium 931 may be configured to include an operating system 933, an application program 935 such as a web browser application, a widget or gadget engine or another application, and a data or database 937.

In FIG. 9, the processor 901 may be configured to communicate with a network 943*b* using the communication subsystem 951. The network 943*a* and the network 943*b* may be the same network or networks or different network or networks. The communication subsystem 951 may be configured to include one or more transceivers used to communicate with the network 943*b*. The one or more transceivers may be used to communicate with one or more remote transceivers of another client node or client device according to one or more communication protocols known in the art or that may be developed, such as IEEE 902.xx, CDMA, WCDMA, GSM, LTE, NR, NB IoT, UTRAN, WiMax, LoRa, or the like.

In another example, the communication subsystem 951 may be configured to include one or more transceivers used to communicate with one or more remote transceivers of another client node or client device according to one or more communication protocols known in the art or that may be developed, such as IEEE 902.xx, CDMA, WCDMA, GSM, LTE, NR, NB IoT, UTRAN, WiMax, LoRa, or the like. Each transceiver may include a transmitter 953 or a receiver 955 to implement transmitter or receiver functionality, respectively, appropriate to the RAN links (e.g., frequency allocations and the like). Further, the transmitter 953 and the receiver 955 of each transceiver may share circuit components, software, or firmware, or alternatively may be implemented separately.

In the current embodiment, the communication functions of the communication subsystem 951 may include data communication, voice communication, multimedia communication, short-range communications such as Bluetooth, near-field communication, location-based communication such as the use of the global positioning system (GPS) to determine a location, another like communication function, or any combination thereof. For example, the communication subsystem 951 may include cellular communication, Wi-Fi communication, Bluetooth communication, and GPS communication. The network 943*b* may encompass wired and wireless communication networks such as a local-area network (LAN), a wide-area network (WAN), a computer network, a wireless network, a telecommunications network, another like network or any combination thereof. For example, the network 943*b* may be a cellular network, a Wi-Fi network, and a near-field network. The power source 913 may be configured to provide an alternating current (AC) or direct current (DC) power to components of the client node 900.

In FIG. 9, the storage medium 931 may be configured to include a number of physical drive units, such as a redundant array of independent disks (RAID), a floppy disk drive, a flash memory, a USB flash drive, an external hard disk drive, thumb drive, pen drive, key drive, a high-density digital versatile disc (HD-DVD) optical disc drive, an internal hard disk drive, a Blu-Ray optical disc drive, a holographic digital data storage (HDDS) optical disc drive, an external mini-dual in-line memory module (DIMM) synchronous dynamic random access memory (SDRAM), an external micro-DIMM SDRAM, a smartcard memory such as a subscriber identity module or a removable user identity (SIM/RUIM) module, other memory, or any combination thereof. The storage medium 931 may allow the client node 900 to access computer-executable instructions, application programs or the like, stored on transitory or non-transitory memory media, to off-load data, or to upload data. An article of manufacture, such as one utilizing a communication system may be tangibly embodied in storage medium 931, which may comprise a computer-readable medium.

The functionality of the methods described herein may be implemented in one of the components of the client node 900 or partitioned across multiple components of the client node 900. Further, the functionality of the methods described herein may be implemented in any combination of hardware, software or firmware. In one example, the communication subsystem 951 may be configured to include any of the components described herein. Further, the processor 901 may be configured to communicate with any of such components over the bus 903. In another example, any of such components may be represented by program instructions stored in memory that when executed by the processor 901 performs the corresponding functions described herein. In another example, the functionality of any of such components may be partitioned between the processor 901 and the communication subsystem 951. In another example, the non-computative-intensive functions of any of such components may be implemented in software or firmware and the computative-intensive functions may be implemented in hardware.

Those skilled in the art will also appreciate that embodiments herein further include corresponding computer programs.

A computer program comprises instructions which, when executed on at least one processor of an apparatus, cause the apparatus to carry out any of the respective processes described above. A computer program in this regard may comprise one or more code modules corresponding to the means or units described above.

Embodiments further include a carrier containing such a computer program. This carrier may comprise one of an electronic signal, optical signal, radio signal, or computer readable storage medium.

In this regard, embodiments herein also include a computer program product stored on a non-transitory computer readable (storage or recording) medium and comprising instructions that, when executed by a processor of an apparatus, cause the apparatus to perform as described above.

Embodiments further include a computer program product comprising program code portions for performing the steps of any of the embodiments herein when the computer program product is executed by a computing device. This computer program product may be stored on a computer readable recording medium.

Figure 10:
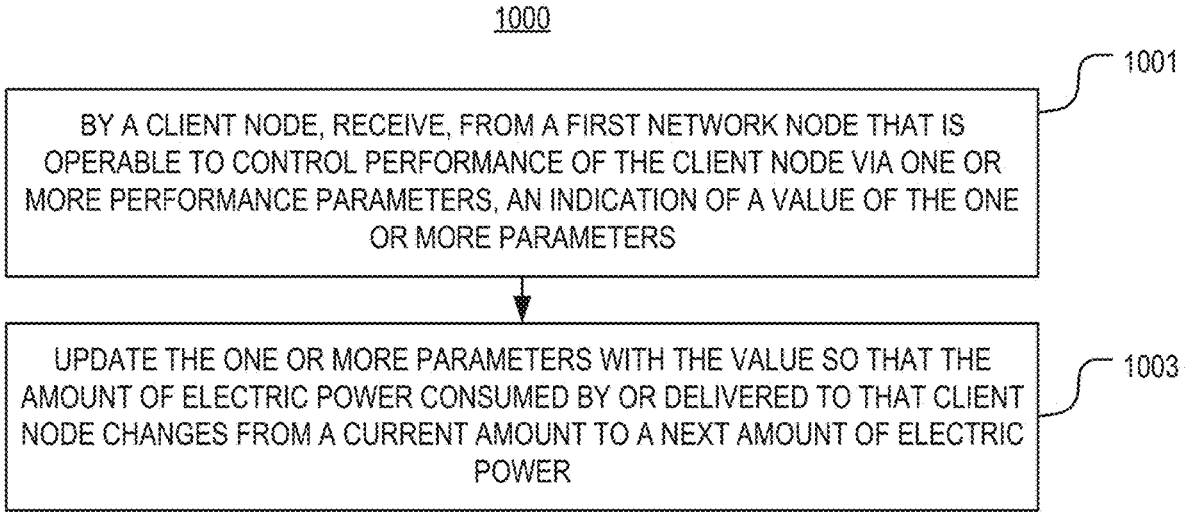
FIG. 10 illustrates one embodiment of a method performed by a client node of controlling performance of the client node served by an electric power utility in accordance with various aspects as described herein.

FIG. 10 illustrates one embodiment of a method 1000 performed by a client node of controlling performance of the client node served by an electric power utility in accordance with various aspects as described herein. In FIG. 10, the method 1000 may start, for instance, at block 1001 wherein it may include receiving, from a first network node that is operable to control performance of the client node via one or more performance parameters, an indication of a value of the one or more parameters. At block 1003, the method 1000 includes updating the one or more parameters with the value so that the amount of electric power consumed by or delivered to that client node changes from a current amount to a next amount of electric power.

Figure 11:
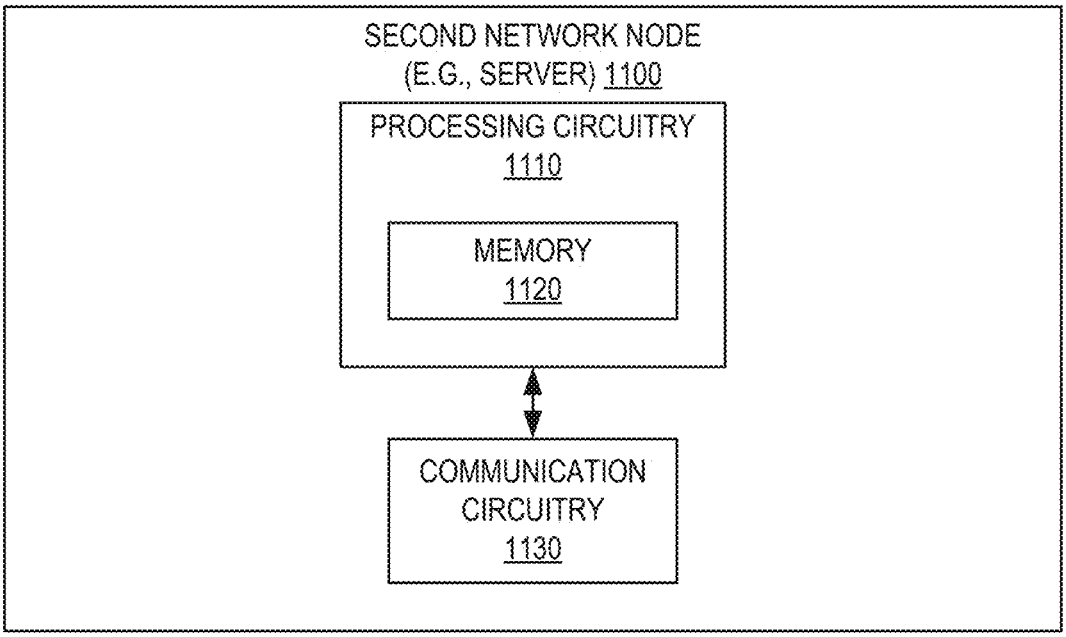
FIG. 11 illustrates one embodiment of a second network node in accordance with various aspects as described herein.

FIG. 11 illustrates one embodiment of a second network node in accordance with various aspects as described herein. As shown, the second network node 1100 includes processing circuitry 1110 and communication circuitry 1130. The communication circuitry 1130 is configured to transmit and/or receive information to and/or from one or more other nodes (e.g., via any communication technology). The processing circuitry 1110 is configured to perform processing described above, such as by executing instructions stored in memory 1120. The processing circuitry 1110 in this regard may implement certain functional means, units, or modules.

Figure 12:
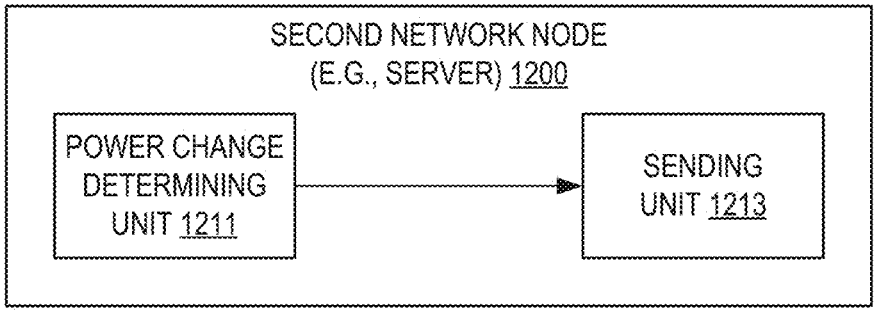
FIG. 12 illustrates another embodiment of a second network node in accordance with various aspects as described herein.

FIG. 12 illustrates another embodiment of a second network node 1200 in accordance with various aspects as described herein. As shown, the second network node 1200 implements various functional means, units, or modules (e.g., via the processing circuitry 1110 in FIG. 11, via software code), or circuits. In one embodiment, these functional means, units, modules, or circuits (e.g., for implementing the method(s) herein) may include for instance: a power change determining unit 1211 for determining to change an amount of electric power consumed or delivered by a plurality of client nodes that are directly or indirectly controlled by a first network node that is operable to control performance of the client nodes served by the utility; and a sending unit 1213 for sending, to a first network node, an indication to change the amount of power consumed or delivered by the client nodes.

Figure 13:
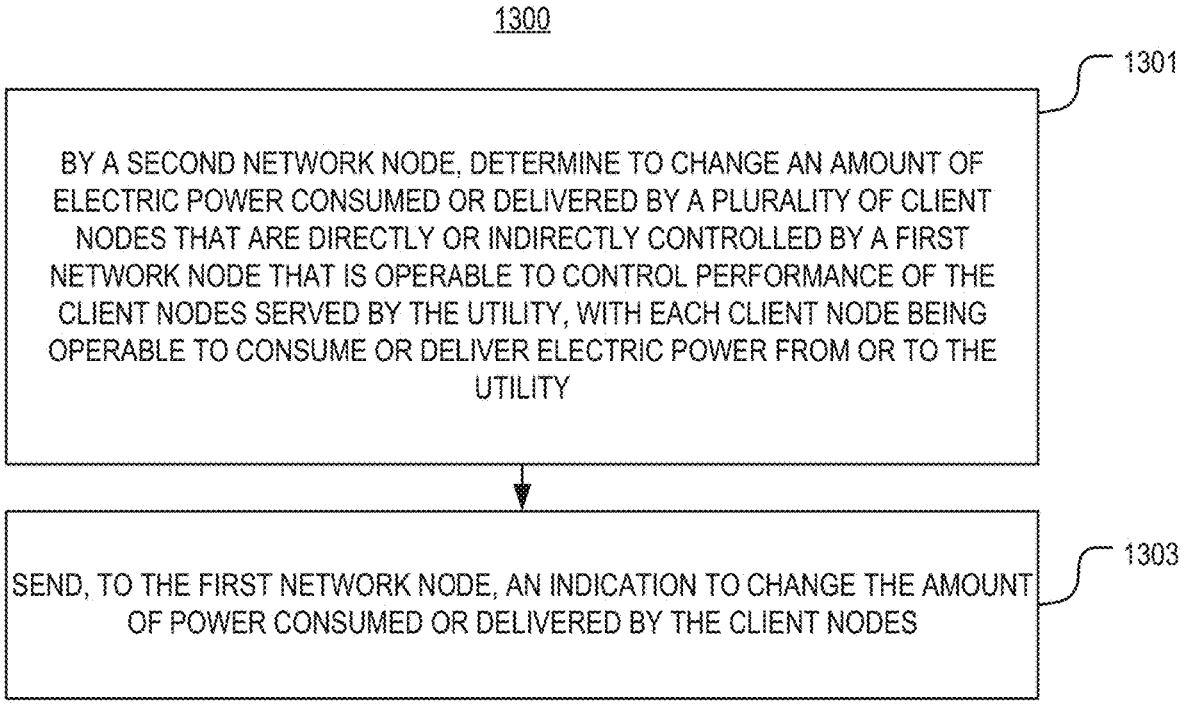
FIG. 13 illustrates one embodiment of a method performed by a second network node of controlling performance of client nodes served by an electric power utility in accordance with various aspects as described herein.
Figure 14:
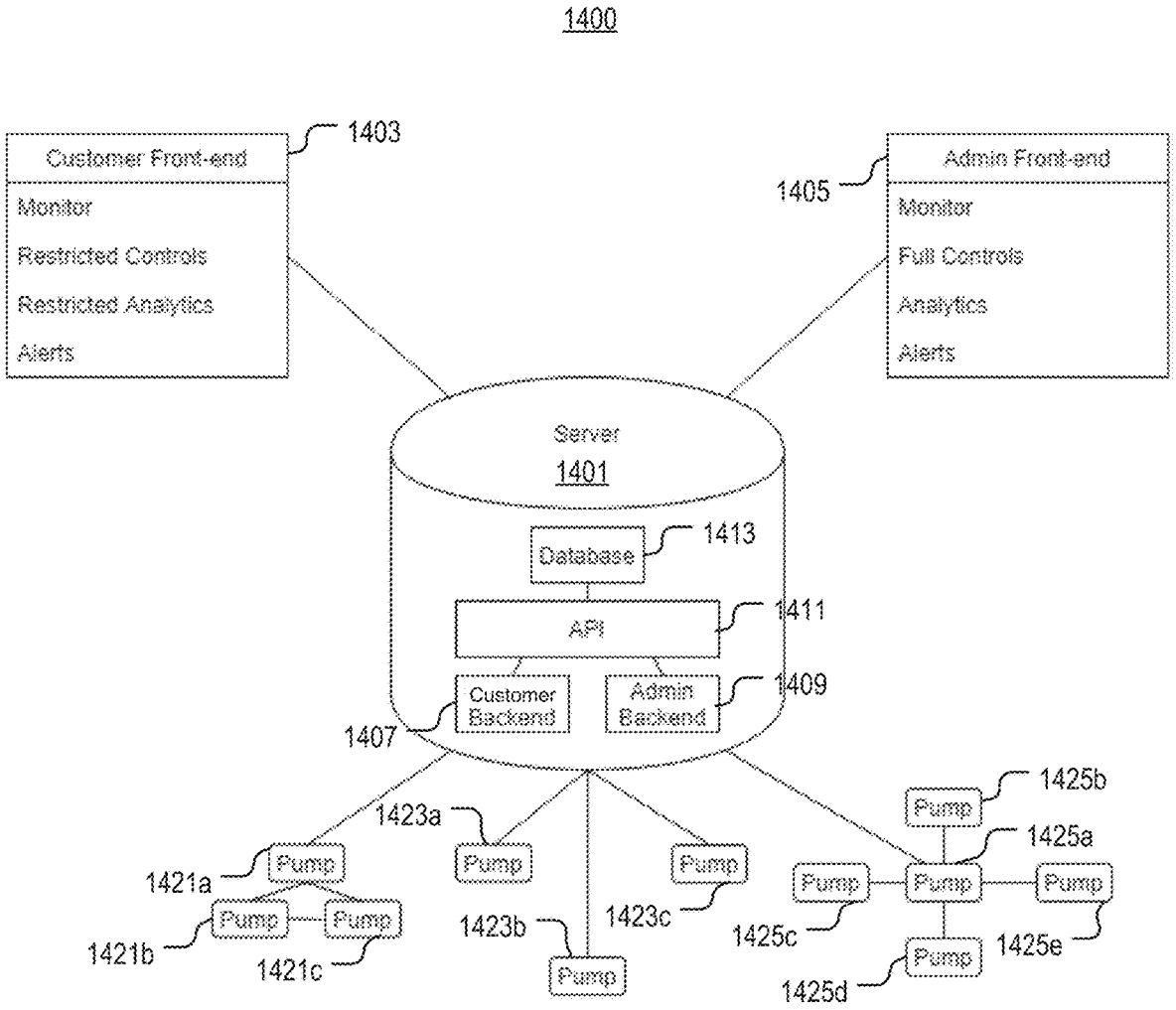
FIG. 14 illustrates another embodiment of a system of enterprise planning and control of well sites in accordance with various aspects as described herein.

FIG. 13 illustrates one embodiment of a method 1300 performed by a second network node of controlling performance of client nodes served by an electric power utility in accordance with various aspects as described herein. In FIG. 13, the method 1300 may start, for instance, at block 1301 where it includes determining to change an amount of electric power consumed or delivered by a plurality of client nodes that are directly or indirectly controlled by a first network node that is operable to control performance of the client nodes served by the utility. Further, each client node being operable to consume or deliver electric power from or to the utility. At block 1303, the method 1300 includes sending, to the first network node, an indication to change the amount of power consumed or delivered by the client nodes FIG. 14 illustrates another embodiment of a system 1400 of enterprise planning and control of well sites in accordance with various aspects as described herein. In FIG. 14, the system 1400 includes a first network node 1401 (e.g., server) having a customer front-end component 1403, an administration front-end component 1405, a customer backend component 1407, an administration backend component 1409, an application programming interface component (API) 1411, a database 1413, the like, or any combination thereof. The server 1401 uses these components to control, via client nodes, electric motors configured to operate pump jacks. The server 1401 is operable to be communicatively coupled to client nodes under various network structures. In one example, a mesh network is comprised of client nodes corresponding to pump jacks 1421*a-c*, with the client node 1421*a* being a gateway client node that is directly communicatively coupled to the server 1401. Accordingly, the server 1401 is directly communicatively coupled to the gateway client node 1421*a* and is indirectly communicatively coupled to the client nodes 1421*b-c* via that gateway client node 1421*a*. In another example, the server 1401 is directly communicatively coupled to each client node having corresponding pump jack 1423*a-c*. In yet another example, a client node corresponding to pump jack 1425*a* is directly communicatively coupled to client nodes corresponding to pump jacks 1425*b-e*. As such, the server 1401 is directly communicatively coupled to the client node 1425*a* and is indirectly communicatively coupled to the client node 1425*b-e* via the client node 1425*a*.

Figure 15:
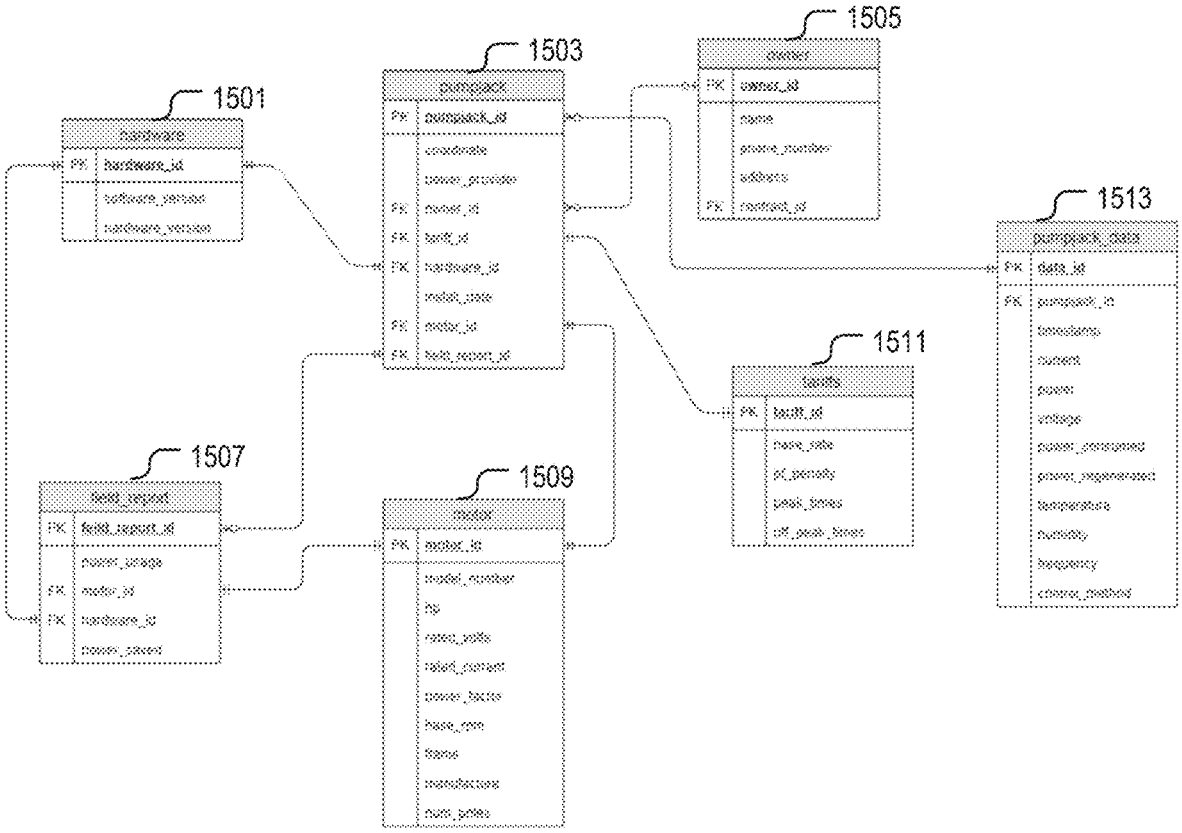
FIG. 15 illustrates parameters for the database of FIG. 14.

FIG. 15 illustrates parameters for the database 1413 of FIG. 14. In FIG. 15, the database 1413 includes hardware parameters 1501, pump jack identifier parameters 1503, owner parameters 1505, field report parameters 1507, motor parameters 1509, tariff parameters 1511, pump jack obtained data parameters 1513, the like, or any combination thereof. The hardware parameters 1501 include information specific to the client node such as a hardware identifier, a software version, a hardware version, the like, or any combination thereof. Further, the pump jack identifier parameters 1503 include information that is specific to the corresponding pump jack such as GPS coordinates, an electric power utility provider, an owner identifier, a tariff or billing schedule of an electric power utility provider, a hardware identifier, an installation date, an electric motor identifier, a field report identifier, the like, or any combination thereof. Also, the owner parameters 1505 include information specific to the owner of the corresponding pump jack such as a name, a phone number, an address, a contact identifier, the like, or any combination thereof.

In FIG. 15, the field report parameters 1507 include field report information for the corresponding pump jack such as power usage, an electric motor identifier, hardware identifier, amount of power saved, the like, or any combination thereof. Further, the motor parameters 1509 include information specific to the electric motor of the corresponding pump jack such as a model number, a horsepower (HP), a rated voltage, a rated current, a power factor, a baseline RPM, a frame, a manufacture, a number of poles, the like, or any combination thereof. Also, the tariffs parameters 1511 include information associated with tariff or billing schedule of an electric power utility provider such as a tariff or billing schedule identifier, a base rate, a power factor penalty, a peak time, a peak time penalty, an off-peak time, the like, or any combination thereof. In addition, the pump jack obtained data parameters 1513 include data obtained from a client node during operation of a corresponding pump jack such as a data identifier, a pump jack identifier, a timestamp of the corresponding data, an electric current of a corresponding motor, an electric power of a corresponding motor, a voltage of a corresponding motor, a power consumed by the pump jack operation (e.g., apparent power, active power, reactive power), a power regenerated by the pump jack operation, a temperature of the client node, a humidity of the client node, a frequency of operation of a corresponding motor, a frequency of operation of the pump jack, a control method, the like, or any combination thereof.

Figure 16:
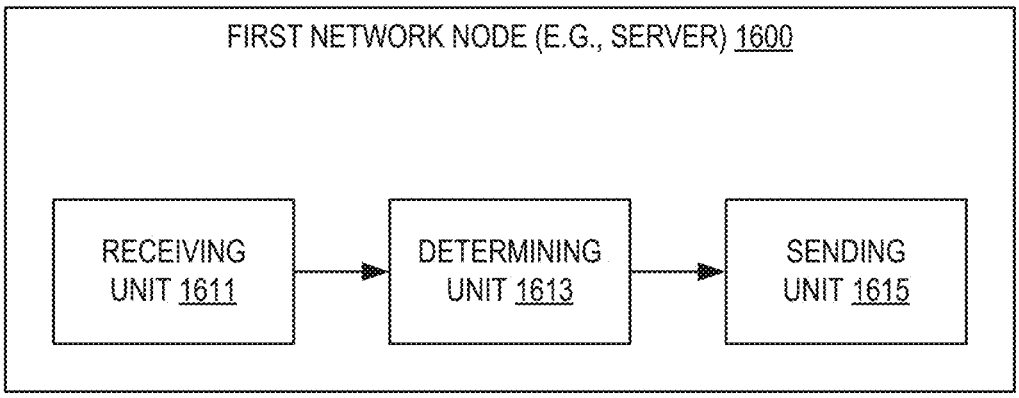
FIG. 16 illustrates another embodiment of a first network node in accordance with various aspects as described herein.

FIG. 16 illustrates another embodiment of a first network node 1600 in accordance with various aspects as described herein. As shown, the first network node 1600 implements various functional means, units, or modules (e.g., via the processing circuitry 310 in FIG. 3, via software code), or circuits. In one embodiment, these functional means, units, modules, or circuits (e.g., for implementing the method(s) herein) may include for instance: a receiving unit 1611 for receiving, from a second network node that is associated with an electric power utility that provides electric power to a motor that operates a pump jack, an indication to change an amount of power consumed by the motor, and for receiving, from the client node, at least one of a value of a first parameter associated with operation of the motor and a value of a second parameter associated with operation of the pump jack; a determining unit 1613 for determining to change the amount of power consumed by the motor; and a sending unit 1615 for sending, to the client node, an indication to change an amount of electric power consumed by the motor to operate the pump jack based on at least one of the values of the first and second parameters so as to reduce an average amount of electric power consumed during a certain time period (e.g., 12 hours, 24 hours, 1 week, 1 month, 1 year, or the like) by the motor in operating the pump jack.

Figure 17:
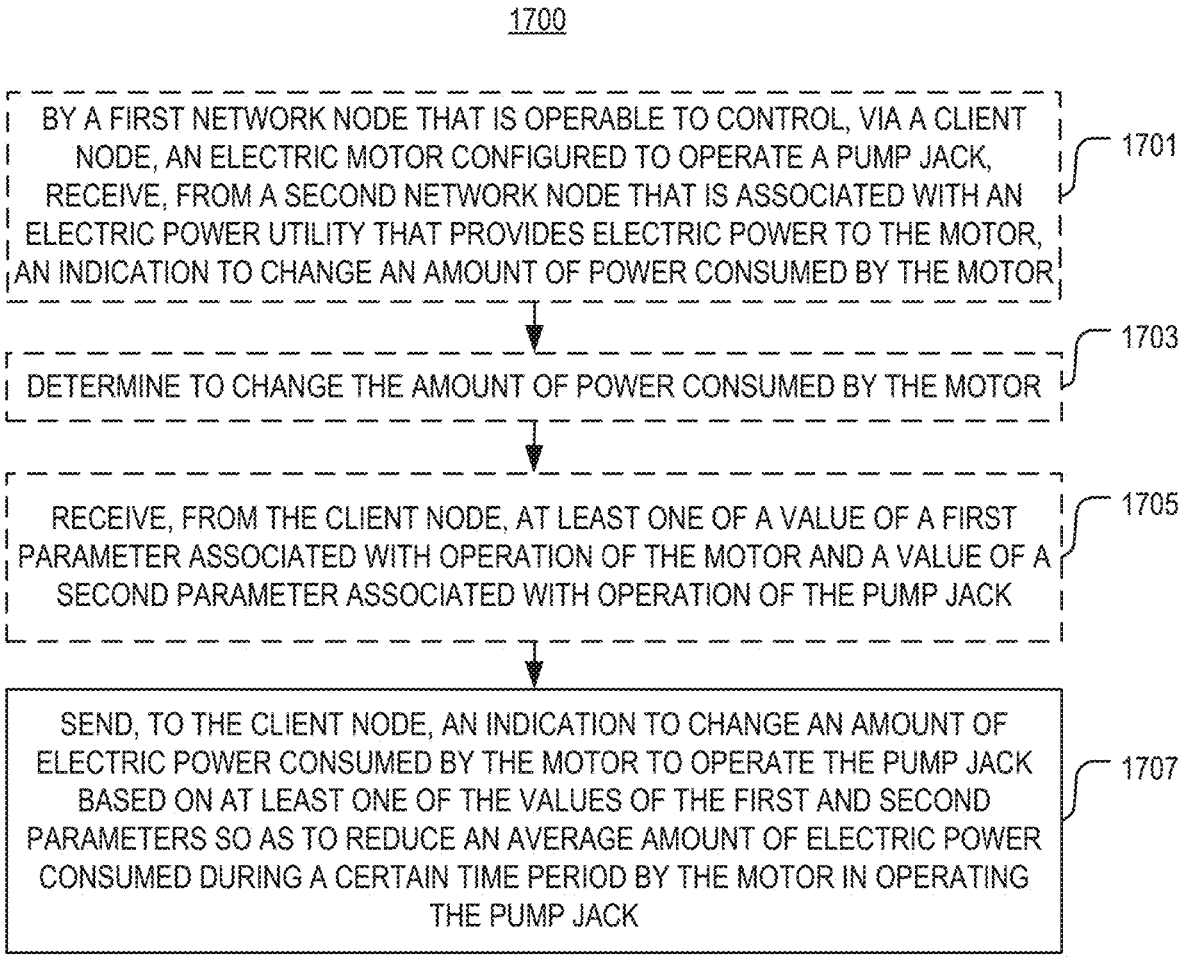
FIG. 17 illustrates one embodiment of a method performed by a first network node of controlling an electric motor that operates a pump jack in accordance with various aspects as described herein.

FIG. 17 illustrates one embodiment of a method 1700 performed by a first network node of controlling an electric motor that operates a pump jack in accordance with various aspects as described herein. In FIG. 17, the method 1700 may start, for instance, at block 1701 where it may include, by a first network node that is operable to control, via a client node, an electric motor configured to operate a pump jack, receiving, from a second network node that is associated with an electric power utility that provides electric power to the motor, an indication to change an amount of power consumed by the motor. At block 1703, the method 1700 may include determining to change the amount of power consumed by the motor. Further, the method 1700 may include receiving, from the client node, at least one of a value of a first parameter associated with operation of the motor and a value of a second parameter associated with operation of the pump jack, as represented by block 1705. At block 1707, the method includes sending, to the client node, an indication to change an amount of electric power consumed by the motor to operate the pump jack based on at least one of the values of the first and second parameters so as to reduce an average amount of electric power consumed during a certain time period by the motor in operating the pump jack.

The previous detailed description is merely illustrative in nature and is not intended to limit the present disclosure, or the application and uses of the present disclosure. Furthermore, there is no intention to be bound by any expressed or implied theory presented in the preceding field of use, background, summary, or detailed description. The present disclosure provides various examples, embodiments and the like, which may be described herein in terms of functional or logical block elements. The various aspects described herein are presented as methods, nodes (or apparatus), systems, or articles of manufacture that may include a number of components, elements, members, modules, nodes, peripherals, or the like. Further, these methods, nodes, systems, or articles of manufacture may include or not include additional components, elements, members, modules, nodes, peripherals, or the like.

Furthermore, the various aspects described herein may be implemented using standard programming or engineering techniques to produce software, firmware, hardware (e.g., circuits), or any combination thereof to control a computing node to implement the disclosed subject matter. It will be appreciated that some embodiments may be comprised of one or more generic or specialized processors such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the methods, nodes and systems described herein. Alternatively, some or all functions could be implemented by a state machine that has no stored program instructions, or in one or more application specific integrated circuits (ASICs), in which each function or some combinations of certain of the functions are implemented as custom logic circuits. Of course, a combination of the two approaches may be used. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The term "article of manufacture" as used herein is intended to encompass a computer program accessible from any computing node, carrier, or media. For example, a computer-readable medium may include: a magnetic storage node such as a hard disk, a floppy disk or a magnetic strip; an optical disk such as a compact disk (CD) or digital versatile disk (DVD); a smart card; and a flash memory node such as a card, stick or key drive. Additionally, it should be appreciated that a carrier wave may be employed to carry computer-readable electronic data including those used in transmitting and receiving electronic data such as electronic mail (e-mail) or in accessing a computer network such as the Internet or a local area network (LAN). Of course, a person of ordinary skill in the art will recognize many modifications may be made to this configuration without departing from the scope or spirit of the subject matter of this disclosure.

Throughout the specification and the embodiments, the following terms take at least the meanings explicitly associated herein, unless the context clearly dictates otherwise. Relational terms such as "first" and "second," and the like may be used solely to distinguish one entity or action from another entity or action without necessarily requiring or implying any actual such relationship or order between such entities or actions. The term "or" is intended to mean an inclusive "or" unless specified otherwise or clear from the context to be directed to an exclusive form. Further, the terms "a," "an," and "the" are intended to mean one or more unless specified otherwise or clear from the context to be directed to a singular form. The term "include" and its various forms are intended to mean including but not limited to. References to "one embodiment," "an embodiment," "example embodiment," "various embodiments," and other like terms indicate that the embodiments of the disclosed technology so described may include a particular function, feature, structure, or characteristic, but not every embodiment necessarily includes the particular function, feature, structure, or characteristic. Further, repeated use of the phrase "in one embodiment" does not necessarily refer to the same embodiment, although it may. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. A node or structure that is "configured" in a certain way is configured in at least that way, but may also be configured in ways that are not listed.

What is claimed is:

1. A method, comprising:

obtaining, by a first network node and from a first client node, a value of a first parameter and a value of a second parameter, the first parameter being associated with operation of a first electric motor configured to operate a first pump jack, and the second parameter being at least one of a composition of fluid produced by the pumpjack or a viscosity of fluid produced by the pumpjack, wherein the first network node is operable to control, via the first client node, the first electric motor configured to operate the first pump jack;

determining, by the first network node and based on the first and second parameters, to change an amount of electric power consumed by the first electric motor so as to reduce an average amount of electric power consumed by the first electric motor;

and in response to the first network node determining to change the amount of electric power consumed by the first electric motor, sending, by the first network node and to the first client node, a first indication to change the amount of electric power consumed by the first electric motor.

2. The method of claim 1, wherein the second parameter is the composition of fluid produced by the pump jack.

3. The method of claim 1, wherein the second parameter is the viscosity of fluid produced by the pump jack.

4. The method of claim 1, wherein the first parameter is associated with an amount of electric power consumed by the motor.

5. The method of claim 1, wherein the first parameter is associated with revolutions per second (RPM) of the motor.

6. The method of claim 1, wherein the first parameter is associated with a power factor (PF) of the motor.

* * * * *